US005090292A

United States Patent [19]

Reip et al.

[11] Patent Number: 5,090,292

[45] Date of Patent: Feb. 25, 1992

[54] SHORT-CIRCUITING SWITCH AND ELECTROMAGNETIC PROJECTILE LAUNCHER INCORPORATING THE SWITCH

[75] Inventors: Paul Reip, Sevenoaks; Melton Mowbray, Melton Mowbray, both of United Kingdom

[73] Assignee: The Secretary of State for Defence in Her Britannic Majesty's Government of the United Kingdom of Great Britain and Northern Ireland, London, England

[21] Appl. No.: 623,741

[22] PCT Filed: Apr. 12, 1989

[86] PCT No.: PCT/GB89/00387

§ 371 Date: Dec. 13, 1990

§ 102(e) Date: Dec. 13, 1990

[87] PCT Pub. No.: WO89/09998

PCT Pub. Date: Oct. 19, 1989

[30] Foreign Application Priority Data

Apr. 13, 1988 [GB] United Kingdom ..... 8808678

[51] Int. Cl.[5] ..... F41B 6/00; H01H 33/14

[52] U.S. Cl. ..... 89/8; 124/3; 200/144 R

[58] Field of Search ..... 89/8; 124/3; 200/144 R

[56] References Cited

U.S. PATENT DOCUMENTS 2,480,553 8/1949 Cooper et al. ..... 200/144 R

FOREIGN PATENT DOCUMENTS 1101573 3/1961 Fed. Rep. of Germany .

2383513 10/1978 France .

*Primary Examiner*—Stephen C. Bentley

*Attorney, Agent, or Firm*—Nixon & Vanderhye

[57] ABSTRACT

An electrical switch for switching large currents in a low voltage circuit consists of two opposing terminals (32) connected to conducting rails (20) of an electromagnetic projectile launcher (10), each terminal having two conducting arms (32A, 32B) which enclose the breech chamber (114) of the launcher. Conducting contacts (66A, 66B) bridging across the opposing arms of the terminals are rapidly lifted to open the switch when the contacts are exposed to propellant gas pressure exerted on a projectile armature (22) slideable within the chamber. Electromagnetic forces of repulsion, which act upon whichever contact is the latter of the two to lift off the terminals, assist simultaneity of current pathway severance across both arms, thereby suppressing arcing at switch opening.

12 Claims, 5 Drawing Sheets

SHORT-CIRCUITING SWITCH AND ELECTROMAGNETIC PROJECTILE LAUNCHER INCORPORATING THE SWITCH

This invention relates to an electrical switch and an electromagnetic projectile launcher incorporating the switch.

Electromagnetic projectile launchers (usually referred to as "railguns") utilise high direct currents (DC) to launch projectiles. The basic construction of a railgun (see FIG. 1) comprises a power supply circuit having two generally parallel rails bridged by a projectile armature. In operation the rails are short-circuited until the current level required for launch is achieved whereupon the current is allowed to flow through the projectile armature. The projectile armature is accelerated to launch speed owing to the interaction of the current in the projectile armature with the magnetic field induced between the rails.

The typical requirements for the switch short-circuiting the rails during the current build up are: very low resistance (usually less than 10 micro-ohms); high-current bearing capability (usually of the order of 1 MA for periods of 200 ms); rapid commutation of the current (typically in 0.5 ms or less); capacity for repeated operation; and capacity for current transfer without damage to itself. Damage during current transfer in this type of switch is most frequently caused by arcing.

It is an object of the present invention to provide an electrical switch which is arc-resistant during switching, and to provide an electromagnetic projectile launcher incorporating the switch.

According to one aspect of the present invention, an electrical switch comprises a pair of terminals, each terminal having first and second conducting arms, a first conductive contact member demountably connected across the respective first conducting arms of the two terminals, a second conductive contact member demountably connected in parallel relationship to the first member across the respective second conducting arms of the two terminals, the two conductive contact members being liftable in different outward directions to sever contact with the terminals, lifting means for lifting at least one of the contact members off the terminals, and connecting means for electrically connecting a direct current power supply across the terminals to provide conductive paths for current flow which diverge outwards along the first and second conducting arms of one terminal, pass across the first and second contact members, and converge inwards along the first and second conducting arms of said other terminal, whereby lifting of one contact member to sever the conductive path during current flow therethrough nullifies the electromagnetic forces of attraction between the contact members and provides an electromagnetic lifting force on said other contact member generated by the combined outward flow of current thereto and inward flow of current therefrom.

The provision of a switch which has two conductive pathways according to the invention has the advantage when the switch is closed that the build-up of current through the closed switch produces increasing electromagnetic forces of attraction between the contact members and so urges them into ever closer and better electrical contact with the terminals. Since the pathways diverge then coverage, a symmetrical shape of current pathways can be provided to ensure matched, equalised current flow through each opposing pair of arms, which balances out any undesirable laterally asymmetric electromagnetic forces which might otherwise act upon the switch if large asymmetrical currents were present. When the switch is opened, simultaneity and rapidity of current severance is assisted by the residual electromagnetic forces of repulsion which act upon whichever of the two contact members is the later of the two to break contact with the terminals. These fast and virtually simultaneous switching characteristics suppress both asymmetrical forces and arcing which might otherwise occur at the moment the switch is opened.

The lifting means, which may comprise a fluid (gas or liquid) pressure generating means, or an electromagnetic or a mechanical lifting means, preferably acts on both contact members simultaneously. By lifting the contact members off the terminals, it is possible to sever a large surface area of contact between those members and the terminals virtually instantaneously, which makes arcing between the two less likely to occur when the switch is opened.

Biasing means are preferably provided which are actuable to return the contact members back into contact with the terminals, and so permit the switch to be used repeatedly. The biasing means are preferably resilient and may comprise a spring for each contact member. Guide means are preferably provided to guide the contact members in opposite directions out of contact with the terminals. Releasable detent means may be provided to retain the contact members in a non-operative, out-of-circuit position once they have been lifted off the terminals.

The contact members are preferably seatable within outwardly-facing recesses extending across the conducting arms of the terminals. The provision of recesses facilitates accurate location of the contact members with the terminals. The recesses and contact members preferably have inwardly-sloped coengageable contact faces to provide a relatively high surface area of electrical contact when the switch is closed and to facilitate rapid severance of the current paths during switch opening. The recesses are most preferably conical.

The forces which act upon the contact members may be varied in the design of the switch for a given current flow. The forces of attraction between the contact members can be varied by altering the distance between them when seated or by altering the magnitude of the force produced by the biasing means. The pressure exerted by the contact members on the terminals may be independently varied by altering the angle of slope of the recesses, which angle is preferably within the range 40°-80° to the lifting direction. This ability to alter the parameters of the switch gives a considerable degree of flexibility in designing the switch to meet a variety of current and voltage requirements.

According to a second aspect of the present invention, an electromagnetic projectile launcher comprises an electrical power supply for supplying direct current, a pair of substantially parallel rails, a projectile armature locatable between said rails for propulsion therealong by electromagnetic forces and an electrical switch in accordance with the first aspect of the invention for short-circuiting the rails, said connecting means of said switch being connected to said power supply and said terminals of said switch being connected to said rails.

Each pair of arms on opposing terminals is preferably separated by insulation, and the arms, together with the insulation where present, preferably enclose a longitudinal breech chamber between the terminals for housing the armature. The rails may extend into the switch. Alternatively, the terminals may form an integral part of the rails at their breech ends.

In order to provide the switch with minimum inductance at opening and so further suppress arcing, the lifting means is preferably actuable to lift at least one of the contact members as the armature passes between them. In particular, the lifting means preferably comprises a pressure generating means for increasing pressure within the breech chamber to accelerate the armature towards a muzzle end of the rails, and means for directing said chamber pressure onto the contact members to provide a lifting force thereon as the moving armature passes the contact members. In this preferred embodiment, the contact members will be situated between the muzzle end of the rails and the pre-launch position of the armature.

Between the said pre-launch position and the contact members, the switch preferably includes an electrically resistive arrangement which offers a conductive path of decreasing electrical resistance for said armature as it approaches the contact members.

Embodiments of electrical switches and an electromagnetic projectile launchers will now be described to illustrate the invention by way of example only with reference to the accompanying drawings, in which FIG. 1 is a schematic circuit diagram showing the basic principle of an electromagnetic projectile launcher, hereinafter referred to as a railgun;

Figure 9:
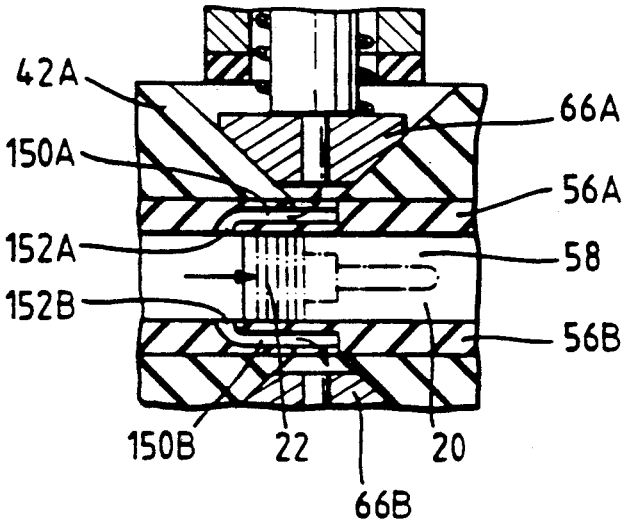
Figure 2:
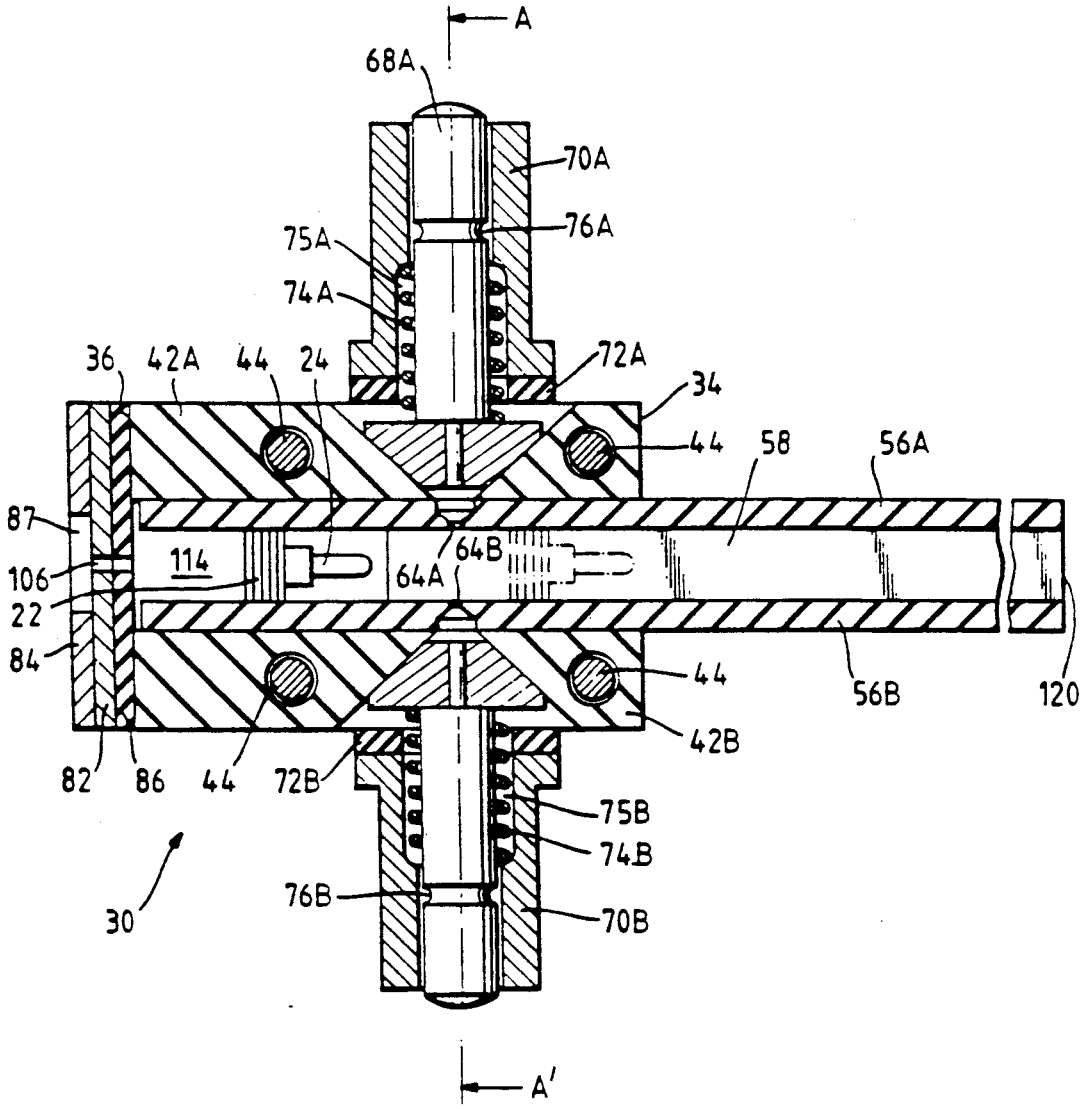
FIG. 2 is a longitudinal sectional elevation of a first embodiment of an electrical switch constructed in accordance with this invention and incorporated within a railgun.
Figure 4:
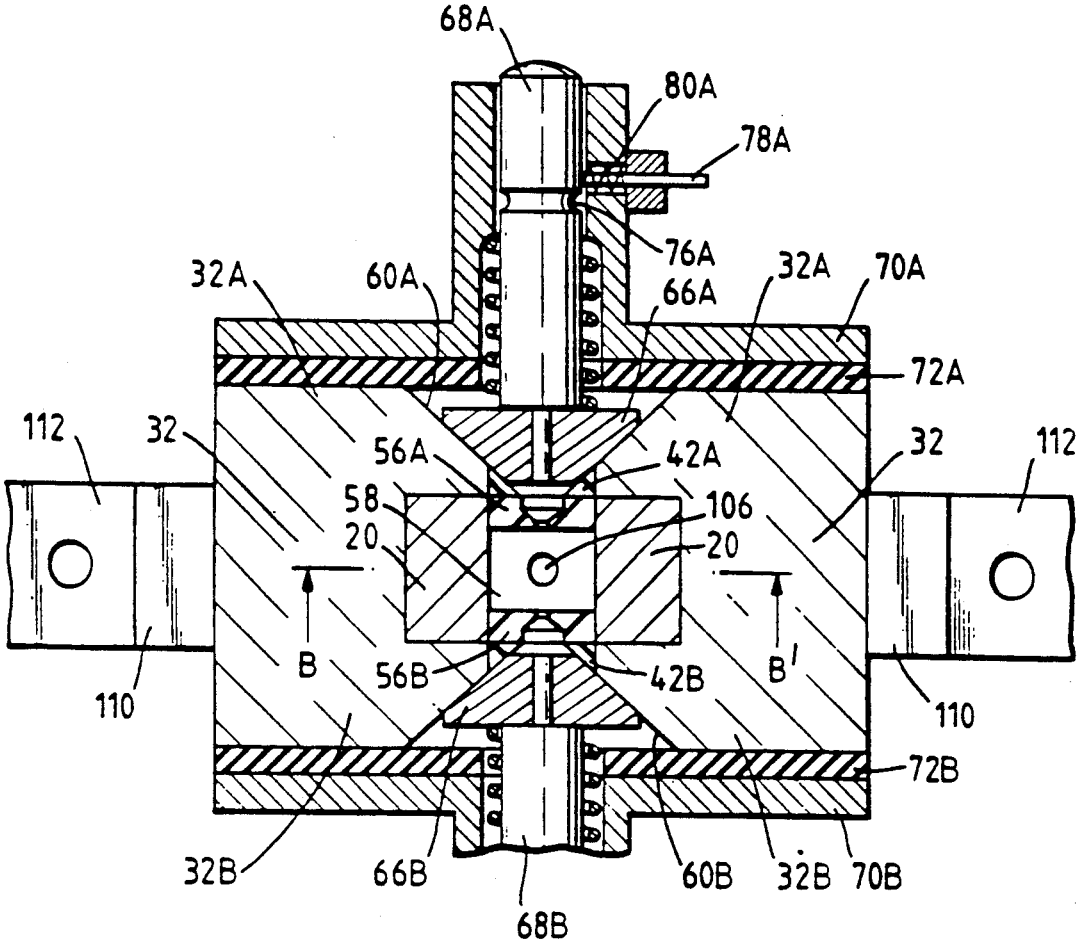
FIG. 4 is a cross-sectional view taken along line AA' of FIG. 2.
Figure 6:
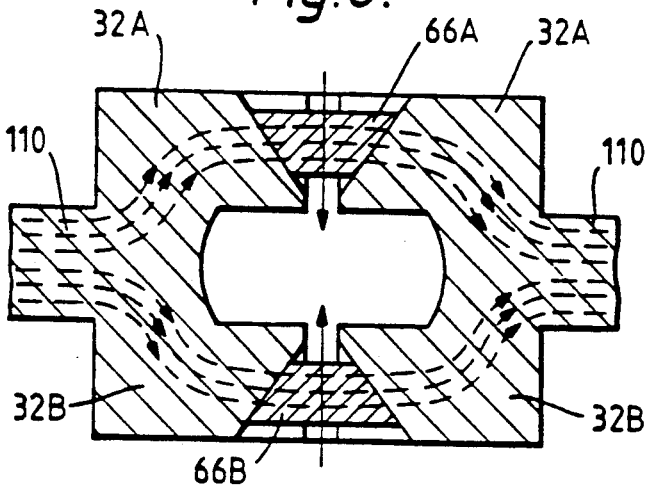
Figure 7:
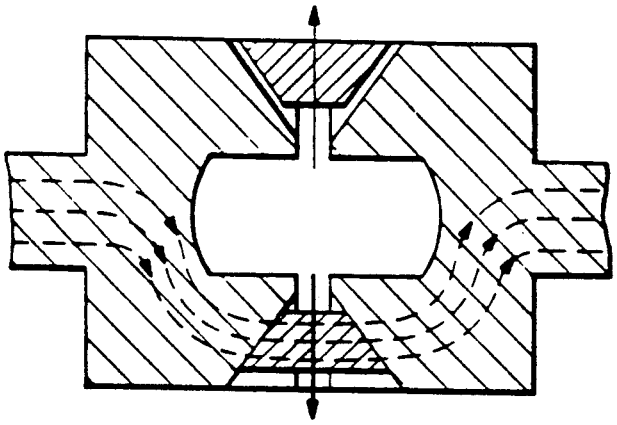
Figure 8:
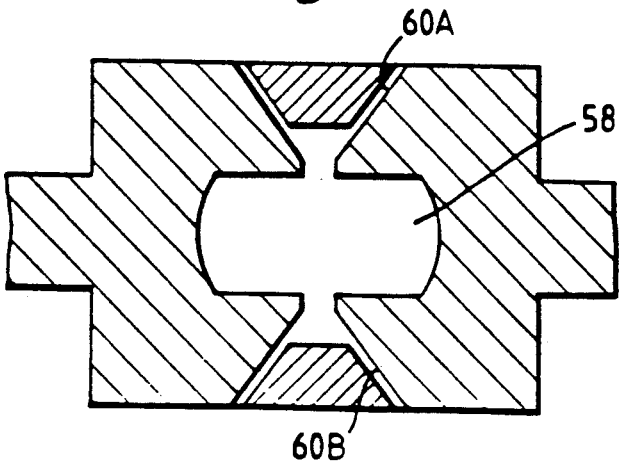

FIGS. 6, 7, and 8 are schematic diagrams of the view shown in FIG. 4, illustrating the conductive paths through the switch before, during, and after the opening sequence thereto; and FIG. 9 is a part sectional elevation of a second embodiment of an electrical switch and projectile launcher identical to that illustrated in FIG. 2 but with a modified switch-opening mechanism.

Figure 1:
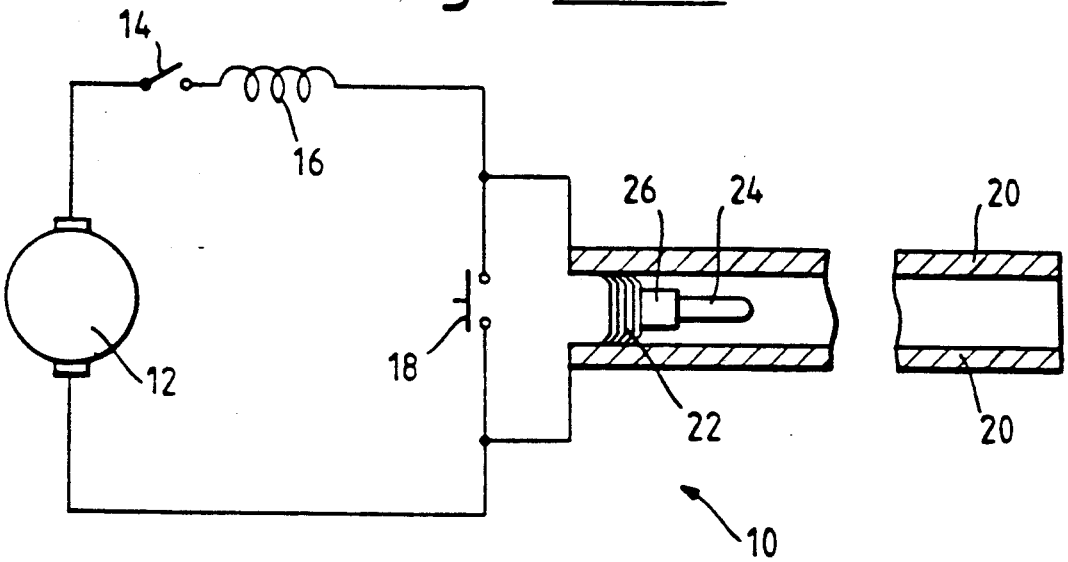
Fig. 1. PRIOR ART

Referring to FIG. 1, a typical electromagnetic projectile launcher, i.e. "railgun", is shown generally at 10. The railgun 10 has an electrical power supply consisting of a homopolar direct current (DC) generator 12; a closing switch 14; a storage inductor 16 (which may be integral with the generator); and a short-circuiting switch 18. Two parallel conducting rails 20 are connected to the supply across the short-circuiting switch 18. A projectile armature 22 is located between the rails 20 and is designed to propel a projectile 24. In general, the projectile armature 22 may be of metal or of other conducting material, insulated at 26 from the projectile 24, or of plasma.

In operation, the switch 14 is closed to charge the inductor 16 and, once the required current level has been achieved, the short-circuiting switch 18 is opened to divert the current through the projectile armature 22. The armature 22 is then propelled by electromagnetic forces along the rails 20 to launch the projectile 24.

Referring to FIGS. 2 to 5, the rails 20 of the railgun 10 are connected to the power supply by a short-circuiting electrical switch 30. The circuit-breaking switch 30 consists of two longitudinal copper terminals 32 of massive construction having forward 34 and rearward 36 ends and having a longitudinal groove in their opposing faces which define to either side of the groove a first conductive arm portion 32A and second conductive arm portion 32B of each terminal. The opposing first arm portions 32A and the opposing second arm portions 32B are separated by insulation 42A and 42B respectively. Bolts 44 pass through this arrangement of terminals 32 and insulation 42 to hold the terminals together against electromagnetic forces acting laterally across the terminals when the switch 30 is connected to the power supply.

The rails 20 of the railgun 10 are inserted into the grooves 38 in intimate electrical contact with the terminals 32, and extend forwardly from the forward end 34. Each rail 20 has a separate, rearward breech section 46 in electrical contact therewith within the groove 38. The breech sections 46 consist of short conducting rails 46 of high electrical resistance relative to the rails 20. For example, the rails 20 may be of copper whereas the breech section 46 may be made of stainless steel. The breech sections 46 are backed by insulation 50 of a length which is less than the length of the short conducting rails 46, thereby allowing electrical contact between a rearward portion 52 of the rails and the short rails 46 at surface 54. The rails 20 and rearward breech sections 46 thereof are maintained in a parallel, separate relationship to one another by parallel insulation 56A, 56B extending the entire length of the rails 20 and breech portions 46. The parallel rails 20 and parallel insulation 56A, 56B together define between them a longitudinal, internal bore 58 of rectangular cross-section for receiving the armature 22.

Right-conical recesses 60A, 60B are formed in the uppermost 62A and lowermost 62B surfaces respectively of the terminals 32 across their first and second arm portions. The recesses 60A, 60B have a common axis of symmetry and communicate with the internal bore 58 of the railgun 10 through portholes 64A, 64B extending laterally from their apexes through the parallel insulation 56A and 56B respectively. Seated within these recesses in electrical contact with both terminals 32 are a pair of substantially identical frustro-conical, plug-like conductive contact members 66A, 66B mounted on moveable guide rods 68A, 68B respectively extending in opposite directions to one another orthogonal to the longitudinal direction of the terminals 32. The facing conductive contact surfaces of the contact members 66A, 66B and of the terminals 32 within the recesses 60A, 60B are preferably made of an arc-resistant material such as tungsten.

The guide rods 68A, 68B are housed within rod bearings 70A, 70B respectively mounted over the recesses on insulation 72A, 72B respectively. The guide rods 68A, 68B are axially moveable within the bearings 70A, 70B to permit the contact members 66A, 66B to be lifted in opposite directions out of contact with the terminals 32. Compression springs 74A, 74B are disposed around the guide rods 68A, 68B respectively within internally-widened portions 75A, 75B of the rod bearings 70A, 70B and act against the contact members 66A, 66B and bearings to urge the contact members against the conductive arm portions 32A, 32B of the terminals 32. This is to ensure that close electrical contact between the contact members 66A, 66B and terminals 32 is maintained even when no current is flowing through the switch 20. Each spindle 66A, 66B has an annular recessed portion 76A, 76B respectively about its circumference. These recessed portions 76A, 76B co-operate, when the contact members 66A, 66B are lifted against the compression springs 74A, 74B out of contact with the terminals, with spring-loaded pins 78A, 78B respectively which are axially slideable into the rod bearings 72A, 72B transverse the rods 68A, 68B and which are urged against the rods by compression springs 80A, 80B respectively.

The rearward, breech end 36 of the terminals 32 is closed by a first 82 and a second 84 steel backing plate isolated from electrical contact with the terminals 32 by an insulating plate 86. Detachably mounted within a recess 87 in the second steel plate 84 is a firing unit 88 consisting of a cylindrical steel retaining unit 90 having a short, truncated gun barrel 92 axially located therein. The gun barrel 92 includes a chamber 94 for receiving a cartridge 96. The retaining unit 90 has an externally threaded portion 98 and screwed onto this portion is a steel housing 99 having an electrically-operated igniter 100 axially mounted therein which communicates with the chamber 94. The muzzle end 102 of the barrel 92 communicates with the breech end 104 of the railgun bore 58 through an axial vent hole 106 in the first backing plate 82 and the insulating plate 86. The muzzle end 102 of the barrel 92 is closed by a bursting disc 108 sandwiched between the first backing plate 82 and the steel retaining unit 90. A clamping mechanism (not shown) pressure seals the backing plates 82, 84 and insulating plate 86 against the rearward end 36 of the terminals 32.

Figure 3:
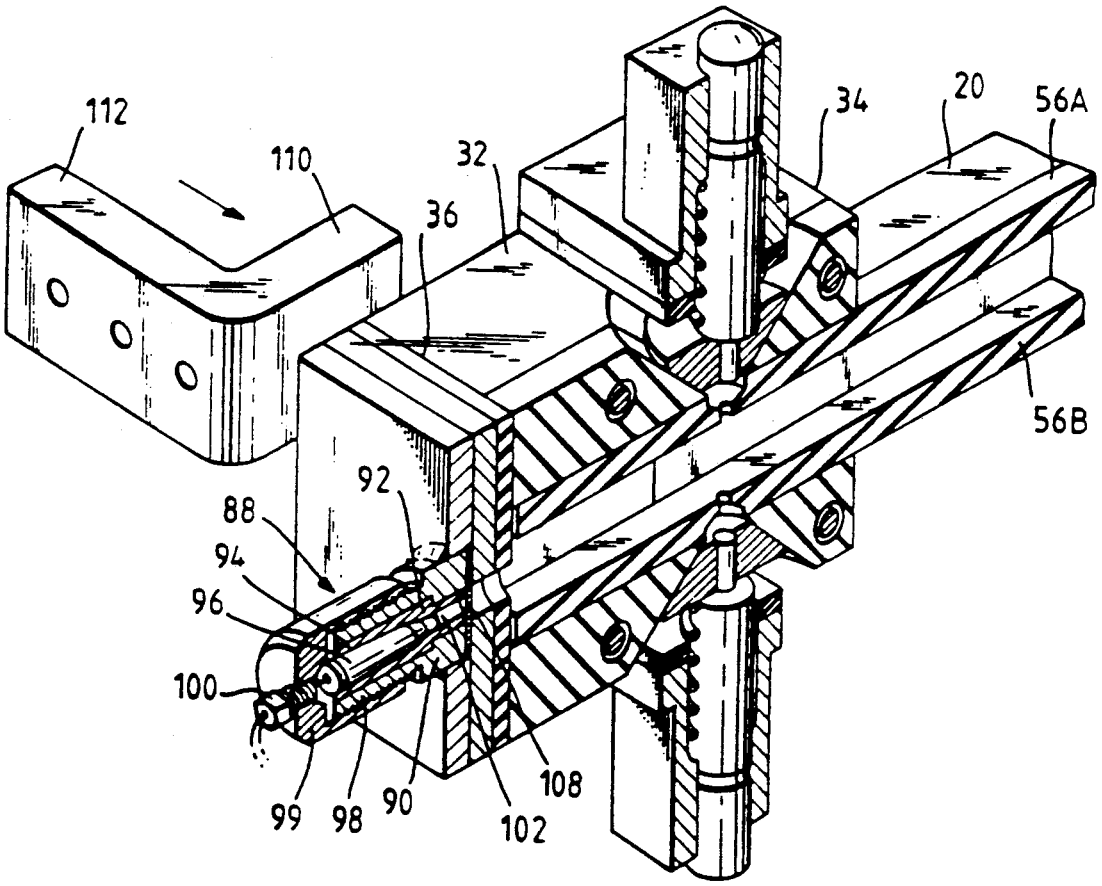
FIG. 3 is a perspective view of the longitudinal sectional elevation illustrated in FIG. 2, additionally showing a firing mechanism for introducing gas pressure into the switch.

The firing unit 88 is loaded by inserting the bursting disc 108 into the recess 87 and securing the retaining unit 90 to the second backing plate 84. The steel housing 99 is unscrewed from the retaining unit 90, a black cartridge 96 containing a gun propellant composition inserted into the chamber 94, and the steel housing 99 screwed back onto the retaining unit 90. The firing unit 88 is then loaded ready for use, as is shown in FIG. 3.

Narrow electrical connectors 110 are provided which are attached (in the direction of the arrow shown in FIG. 3) longitudinally on opposite sides of the terminals 32 adjacent the bore 58 and which have flanged portions 112 extending in opposite direction adjacent the rearward ends 36 of the terminals. These flanged portions 112 are connected to the power supply. The width of the connectors 110 is considerably less than that of the terminals 32 and approximates to that of the bore 58, so that in a plane lateral to the longitudinal direction of the terminals 32, direct electrical current flowing in either a forward or reverse direction through the switch 30 is directed from one connector 110 outwards along each arm portion 32A, 32B of one terminal 32, across the contact members 66A, 66B inwards along each arm portion 32A, 32B of the other terminal 32, and out through the other connector 110.

The operating sequence of the railgun 10 of FIGS. 2 to 5 incorporating the present short-circuiting switch 30 will now be described with additional reference to FIGS. 6 to 8.

Figure 5:
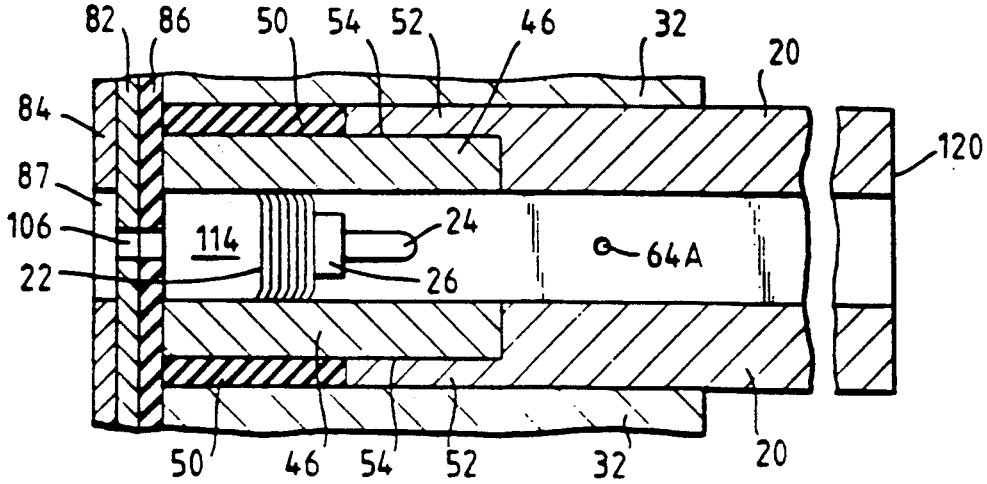
FIG. 5 is a part-sectional view taken along line BB' of FIG. 4.

The projectile armature 22 with its associated insulation 26 and projectile 24 are loaded into the breech area of the railgun 10 into the position shown in FIGS. 2 and 5 across the short conducting rails 46. Loading is facilitated by providing that the array of insulating plate 86 and backing plates 82, 84 are hinged (not shown) to one of the terminals 32 to allow breach loading of the armature. The clamping mechanism may be provided with a quick-release mechanism (not shown) for rapid reloading if required. The switch 14 is then closed to allow for the charging of the inductor 16. Current flows from the generator 12, through the inductor 16 and switch 30, and back to the generator 12 to complete the circuit. The current flow through the switch 30 at this point is shown schematically in FIG. 6. The current fed into the switch 30 through one of the relatively narrow connectors 110 divides outwardly along each conductive arm portion 32A, 32B of one terminal 32, flows along parallel flow paths across each of the moveable plug-like contact members 66A, 66B, and finally flows inwards along each arm portion 32A, 32B of the other terminal 32 to reunite before flowing out of the switch through the other connector 110. Electromagnetic forces present in the switch 30 at this stage urge the two moveable contact members 66A, 66B towards each other, due to the parallel and unidirectional flow of current through them, and thereby into ever closer contact with the terminals 32. Current also flows through the armature 22 at this point, but the size of the current is relatively small because it has to follow a path through the high resistance short conducting rails 46.

When the inductive energy stored in the inductor 16 has reached a desired level, an electrical signal triggers the ignitor 100 which in turn ignites the combustible material in the cartridge 96. Pressure builds up within the gun barrel 92 until the disc 108 bursts and propellant gases vent through the axial vent hole 106 to pressurise the breech area 114 of the bore 58 between the insulating plate 86 and the armature 22. The thickness of the disc 108 will in general be sufficient to ensure that substantially all the combustible material is consumed before the disc 108 bursts.

The pressure in the breech area 114 of the bore 58 causes the armature 22 to move forwards towards the rails 20. This increases the current through the armature 22 because the forward movement of the armature shortens the conductive path lengths through high resistance short rails 46. Eventually, the armature 22 moves into contact with the rails 20. By this time, a significant proportion of current through the switch 30 is being diverted through the armature 22, advantageously reducing somewhat the attractive electromagnetic forces acting upon the moveable contact members 66A, 66B. The use of the aforementioned high resistance short rails 46 ensures that the armature 22 initially experiences very little current and is thus protected from overheating during current buildup in the railgun circuit 10. They also provide a graded resistance flow path for the moving armature 22 and so reduces arcing which might otherwise be caused by very rapid current commutation through the armature.

The armature 22 continues to move forward under gas pressure until it uncovers the portholes 64A, 64B. Propellant gases flow through these portholes 64A, 64B and exert increasing gas pressure on the moveable contact members 66A, 66B until this pressure provides an outwardly-acting force on one of the contact members 66A or 66B which exceeds the combined electromagnetic and compression-spring induced force acting inwardly on said member, thereby ejectably lifting the contact member 66A or 66B outwards from its seat and severing the conductive path across its associated pair of either first 32A or second 32B conductive arms portions. Simultaneous lifting of both contact members 66A, 66B by gas pressure is unlikely to occur because inperceptible differences in the forces acting on each member will inevitably exist within the switch 30.

The current flow through the switch 30 at this point (ignoring for convenience the current flow through the armature) is shown in FIG. 7. The severing of one conductive path across the terminals 32 removes the electromagnetic force of attraction that exists between the contact members 66A, 66B and increases the current flow through the remaining current path (shown in FIG. 7 through the second arm portions 32B and contact member 66B) since the switch 30 does not represent the sole resistive element present in the railgun circuit. Immediately the conductive path across the first arm portions 32A is severed, the outward and inward flow of current flowing in opposite directions along the two opposed second arm portions 32B create, in effect, a short-length railgun whose electromagnetic forces with the assistance of propellant gas pressure very rapidly lift the contact member 66B in the opposite direction (see thick arrow, FIG. 7) to that of the conductive member 66A (see thin arrow, FIG. 7), thereby rapidly severing the remaining conductive path through the switch 30. Full current flow through the switch 30 is thereby commutated through the armature 22 which then accelerates to launch speed between the launch rails 20 towards the muzzle end 120 of the railgun 10.

As the contact members 66A, 66B are ejected outwards under the influence of electromagnetic forces and/or gas pressure, they are guided on the guide rods 68A, 68B through the rod bearings 70A, 70B until the annular recessed portions 76A, 76B of the spindles draw level with the spring loaded pins 78A, 78B. The pins 78A, 78B are urged forward by their associated compression springs 80A, 80B to lock the rods 68A, 68B, and hence each contact member 66A, 66B in a lifted position out of contact with the terminals 32.

Arcing across the switch 30 at current commutation is suppressed for a variety of reasons. Firstly, the frustro-conical contact members 66A, 66B within the recesses 60A, 60B present relatively large contact areas to their respectively adjacent opposed conductive arm portions 32A, 32B. This results in relatively low current densities through the these contact members. Secondly, once contact across one contact member 66A or 66B is broken, the electromagnetic, railgun-type forces of repulsion acting on the other contact member 66A or 66B assist in its extremely rapid separation from its associated conductive arm portions 32A or 32B, and rapid switch opening is known to suppress arcing. Thirdly, in the arrangement shown the current is commutated as the armature 22 passes the common, lateral axis of the two contact members 66A, 66B, and due to the close proximity of the armature 22 and contact members at commutation, the change in current flow through the railgun circuit 10 in minimised. This in turn suppresses arcing at current commutation, because the stored energy in (and hence inductance of) that part of the switch 30 taken out of circuit at commutation is low.

Once the launch sequence has been completed and the projectile 24 launched, the contact members 66A, 66B may be returned to their pre-launch positions ready for launching a fresh armature 22 and projectile, by pulling out each pin 78A, 78B in turn. The contact member 66A, 66B are then urged inwards towards each other under the influence of the compression springs 74A, 74B until they once again bridge across the opposed arm portions 32A, 32B of the terminals and reconnect the conductive paths through the switch 30. It will be realised by those skilled in the art that withdrawal of the pins 78A, 78B may be automated and may be effected rapidly. It is therefore possible to reconnect the switch 30 across the contact members 66A, 66B within milliseconds of the conductive paths being severed, so that reconnection may be effected to short-circuit the launch rails 20 as the armature 22 leaves the muzzle end 120 of the railgun 10. This suppresses arcing created by the moving armature 22 as it disconnects from the launch rails 20.

Referring lastly to FIG. 9, there is illustrated an electrical switch incorporated within a projectile launcher which apart from certain differences which will now be described is in all other respects identical to that illustrated in FIGS. 2 to 5. The recesses 60A, 60B communicate with the internal bore 58 through angled portholes 150A, 150B which extend rearwardly from the apexes of the recesses through the parallel insulation 56A, 56A and emerge through openings 152A, 152B. The rearward extension of the portholes 150A, 150B is sufficient to uncover the opening 152A, 152B fully and expose them to propellant gas pressure just before the armature 22 travels to a point directly between the contact members 66A, 66B. In this way, each contact members 66A, 66B is exposed to a lifting force, provided by propellant gas pressure, at the approximate moment when it is at or approaching its closest proximity to the armature 22. This ensures that the switch opens to divert full current flow through the armature at a point where the stored energy (hence inductance) in the switch is at a minimum.

We claim:

1. An electrical switch comprising a pair of terminals (32) each terminal having first (32A) and second (32B) conducting arms, a first conductive contact member (66A) demountably connected across the respective first conducting arms (32A) of the two terminals, a second conductive contact member (66B) demountably connected in parallel relationship to the first member across the respective second conducting arms (32B) of the two terminals, the two conductive contact members being liftable in different outward directions to sever contact with the terminals, lifting means (96) for lifting at least one of the contact members (66A, 66B) off the terminals (32), and connecting means (110) for electrically connecting a direct current power supply across the terminals (32) to provide conductive paths for current flow which diverge outwards along the first and second conducting arms of one terminal, pass across the first and second contact members, and converge inwards along the first and second conducting arms of said other terminal, whereby lifting of one contact member to sever the conductive path during current flow therethrough nullifies electromagnetic forces of attraction between the contact members and provides an electromagnetic lifting force on said other contact member generated by the combined outward flow of current thereto and the inward flow of current therefrom.

2. Switch according to claim 1 characterised in that the lifting means (96) is arranged to act substantially simultaneously upon both contact members (66A, 66B).

3. Switch according to claim 1 further including biasing means (74A, 74B) actuable to return the contact members back into contact with the terminals (32).

4. Switch according to claim 1 characterised in that guide means (68A, 70A, 68B, 70B) are provided to guide the contact members (66A, 66B) in different directions out of contact with the terminals (32).

5. Switch according to claim 1 characterised in that the contact members (66A, 66B) are each seatable within outwardly-facing recesses (60A, 60B) extending across the conducting arms (32A, 32B) of the terminals.

6. Switch according to claim 5 characterised in that the recesses (60A, 60B) and contact members (66A, 66B) have inwardly-sloped coengageable contact faces.

7. Switch according to claim 6 characterised in that the recesses (60A. 60B) and contact members (66A, 66B) are conical.

8. An electromagnetic projectile launcher comprising an electrical power supply (12) for supplying direct current, a pair of substantially parallel rails (20), a projectile armature (22) locatable between said rails for propulsion therealong by electromagnetic force and an electrical switch (18) for short-circuiting the rails, characterised in that the switch comprises an electrical switch (30) according to any one of the preceding claims, said connecting means (110) of said switch being connected to said power supply and said terminals (32) of said switch being connected to said rails.

9. Launcher according to claim 8 characterised in that the conducting arms (32A, 32B) of the two terminals (32) together enclose a longitudinal breech chamber (114) of the launcher for housing the armature (22).

10. Launcher according to claim 8 characterised in that the rails (20) have opposing resistive portions (46) extending longitudinally within the breech chamber (14) to provide conductive pathways through the armature (22) of decreasing electrical resistance as the armature moves through the breech chamber (114) towards the muzzle end (120) of the rails (20).

11. Launcher according to claim 10 characterised in that the resistive portions (46) are located within the breech chamber (114) such that during launch the armature (22) slideably engages the resistive portions before passing between the contact members (66A, 66B).

12. Launcher according to claim 9 wherein the lifting means (96) is actuable to lift at least one of the contact members (66A, 66B) as the armature (22) passes between them.

* * * * *

UNITED STATES PATENT AND TRADEMARK OFFICE

CERTIFICATE OF CORRECTION

PATENT NO. : 5,090,292

DATED : February 25, 1992

INVENTOR(S) : Paul REIP and Andrew CALLICK

It is certified that error appears in the above-identified patent and that said Letters Patent is hereby corrected as shown below:

Title page, item [75] should read --Inventors: Paul Reip, Sevenoaks; Andrew Callick, Melton Mowbray, both of United Kingdom--

Signed and Sealed this

Fifteenth Day of June, 1993

*Attest:*

Michael K. Kirk

MICHAEL K. KIRK

*Attesting Officer*

*Acting Commissioner of Patents and Trademarks*